US007357059B2

(12) United States Patent
Könicke

(10) Patent No.: US 7,357,059 B2
(45) Date of Patent: Apr. 15, 2008

(54) MECHANICAL INITIATING SYSTEM FOR CASELESS AMMUNITION

(75) Inventor: Helmut Könicke, Röthenbach (DE)

(73) Assignee: Diehl BGT Defence GmbH & Co., KG, Überlingen (DE)

( * ) Notice: Subject to any disclaimer, the term of this patent is extended or adjusted under 35 U.S.C. 154(b) by 137 days.

(21) Appl. No.: 11/337,419

(22) Filed: Jan. 23, 2006

(65) Prior Publication Data

US 2006/0254109 A1 Nov. 16, 2006

(30) Foreign Application Priority Data

Feb. 3, 2005 (DE) ..... 10 2005 004 936
Mar. 17, 2005 (DE) ..... 10 2005 012 284

(51) Int. Cl.
*F41A 3/00* (2006.01)

(52) U.S. Cl. ..... 89/26

(58) Field of Classification Search ..... 89/22, 89/24, 26

See application file for complete search history.

(56) References Cited

U.S. PATENT DOCUMENTS 1,313,912 A 8/1919 Reising
1,345,565 A 7/1920 Thompson
3,474,560 A * 10/1969 Ramsay ..... 42/17
3,547,001 A 12/1970 Stoner
3,728,938 A 4/1973 Scribor et al.
3,872,615 A * 3/1975 Grandy ..... 42/49.01
3,954,042 A * 5/1976 Hupp et al. ..... 89/155
3,986,431 A 10/1976 Sackenreuter et al.
4,206,683 A 6/1980 Ringelhan
4,581,836 A 4/1986 Baker et al.
5,235,770 A 8/1993 Simon et al.

FOREIGN PATENT DOCUMENTS

CH 91600 11/1921
CH 509 563 8/1971
DE 29 88 15 5/1916
DE 24 05 763 C3 2/1974
GB 230 870 10/1925

* cited by examiner

*Primary Examiner*—Michael J. Carone
*Assistant Examiner*—Gabriel J Klein
(74) *Attorney, Agent, or Firm*—Scully, Scott, Murphy & Presser, P.C.

(57) ABSTRACT

A mechanical initiating system (10) for caseless ammunition including a weapon breech block and a powder body chamber adjoining the weapon breech block. A firing pin is axially displaceably arranged in a through hole (26) formed in the weapon breech block. A powder body, which can be initiated by the firing pin and having a priming device, is arranged in the powder body chamber. In order to achieve a reliable and simple sealing between the firing pin and the inside wall of the through hole, the weapon breech block has a grease reservoir which is open facing towards the through hole, and the firing pin is peripherally provided with at least one grease groove.

8 Claims, 2 Drawing Sheets

MECHANICAL INITIATING SYSTEM FOR CASELESS AMMUNITION

BACKGROUND OF THE INVENTION

1. Field of the Invention

The invention pertains to an initiating system for caseless ammunition, including a weapon breech block and a powder body chamber adjoining the weapon breech block at the front end thereof. A firing pin is axially displaceably arranged in a through hole formed in the weapon breech block and wherein a powder body which can be initiated by the firing pin and having a priming means are arranged in the powder body chamber.

2. Discussion of the Prior Art

German Patent Publication DE 21 05 295 C1 discloses a powder body for caseless ammunition, in particular for automatic weapons, comprising at least two pressings of which one serves as a support for the priming means. That known ammunition is initiated by means of an impact-sensitive fuse composition. That known powder body is characterized by a cup-shaped powder body pressing, on the cup bottom wall of which the priming means is provided at the cavity side. The cup-shaped powder body pressing covers an anvil-like propellant charge pressing which serves as a support for the priming means. The cup-shaped powder body pressing and the anvil-like propellant charge pressing are connected together preferably by an adhesive join. The firing pin described in that publication for initiating the described powder body is arranged in a through hole of a breech with guide portion. For piercing, that is to say initiating, the powder body, that is to say the caseless ammunition, the firing pin must perform two functions:

1. The tip of the firing pin must penetrate into the powder body and initiate the priming means by impact or friction; and 2. The firing pin must seal off the through hole in which it is axially displaceable, after firing, in relation to the high gas pressure of the hot powder gases. For that purpose above-mentioned DE 21 05 295 C1 diagrammatically shows a ring seal or a precise fit between the firing pin and the wall of the through hole. It has been found however that such a precise fit on its own is not adequate in the long term.

SUMMARY OF THE INVENTION

The object of the present invention is to provide an initiating system of the kind set forth in the opening part of this specification, wherein reliable and durable sealing of the firing pin in the through hole provided for same is achieved with simple means.

In accordance with the invention, in an initiating system of the kind set forth in the opening part of this specification, that object is attained in that the weapon breech block includes a grease reservoir which is open facing towards the through hole, and wherein the firing pin is peripherally provided with at least one grease groove. Preferred configurations and developments of the initiating system according to the invention are characterized in the appendant claims.

The invention has the advantage that, in any travel position of the firing pin, the arrangement ensures reliable sealing of the firing pin relative to the wall of the through hole provided for same in the weapon breech block.

BRIEF DESCRIPTION OF THE DRAWINGS

Further details, features and advantages will be apparent from the description hereinafter of an embodiment, of which a portion is shown in the drawing in partial section, not to scale, of the initiating system according to the invention, in two different operating conditions.

DETAILED DESCRIPTION OF THE INVENTION

Figure 1:
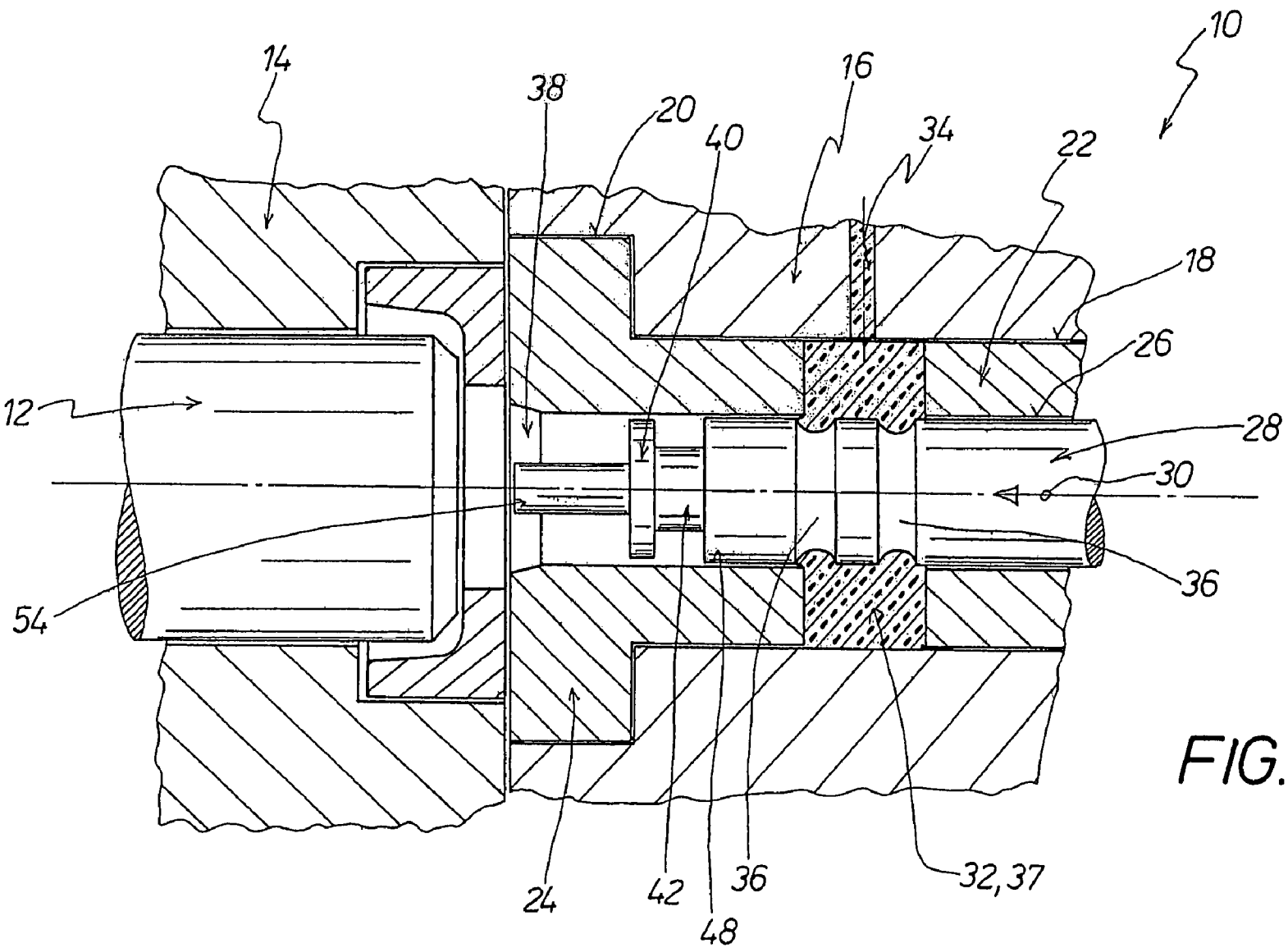
FIG. 1 shows the initiating system in the starting position of the firing pin.

FIG. 1 is a view in longitudinal section on an enlarged scale, not being true to scale, of a portion of a configuration of the initiating system 10 for an item of caseless ammunition, of which a portion of the powder body 12 is illustrated. The powder body 12 is positioned in a powder body chamber. Adjoining the powder body chamber 14 is a weapon breech block 16 provided with a through hole 18. The through hole 18 has a peripherally extending enlargement 20 at its front side, which is towards the powder body chamber 14. Arranged in the through hole 18 in the weapon breech block 16 is a sealing bushing 22 which at its front end has a peripherally extending collar 24. The collar 24 is disposed in the enlargement 20 so that the sealing bushing 22 is immovable axially rearwardly with respect to the weapon breech block 16.

The sealing bushing 22 has a firing pin through hole 26 in which a firing pin 28 is axially displaceably arranged. The firing pin 28 is moved for example by means of a control portion (not shown) from the starting position shown in FIG. 1 into the final firing position shown in FIG. 2. That movement is indicated by the arrow 30 in FIG. 1.

The sealing bushing 22 arranged in the weapon breech block 16 for the firing pin 28 is provided with a grease reservoir 32, which is connected to a grease source (not shown) by means of a grease duct 34, which extends through the weapon breech block 16.

The firing pin 28 is provided with at least one peripherally extending grease groove 36. In the structure shown in FIG. 1 the firing pin 28 is provided with two mutually axially spaced, peripherally extending grease grooves 36.

In the starting position of the firing pin 28 as shown in FIG. 1 the grease grooves 36 are associated with the grease reservoir 32 so that the grease grooves 36 are filled with grease 37 disposed in the grease reservoir 32.

Figure 2:
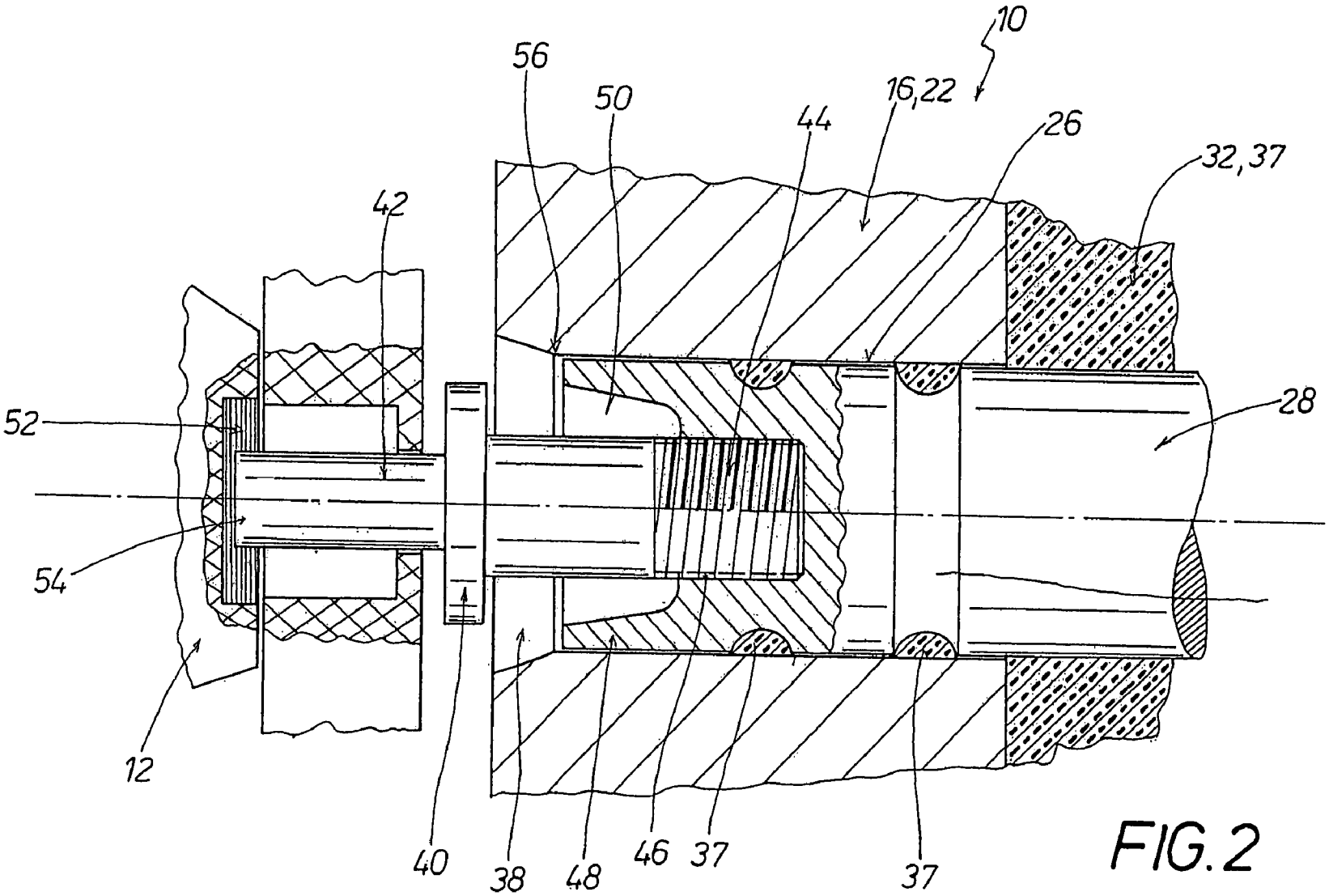
FIG. 2 shows the initiating system in the final firing position of the firing pin.

When the firing pin 28 is accelerated from the starting position shown in FIG. 1 into the final firing position shown in FIG. 2, the grease grooves 36 entrain the grease 37 disposed therein, whereby a film of grease is produced between the firing pin 28 and the through hole 26 in the sealing bushing 22, the film of grease contributing to gas sealing and to avoiding friction marks.

As can be seen from FIGS. 1 and 2 in which the same details are each identified by the same reference, the through hole 26 for the firing pin 28 is provided, at its front end towards the powder body chamber 14, with an entry portion 38 which enlarges towards the powder body chamber 14. The entry portion 38 is of a frustoconically enlarged configuration, with a shallow cone angle. Likewise it is for example possible for the entry portion 38 to be of an enlarged configuration with a gentle radius.

At its front end the firing pin 28 has a deflector 40, the mode of operation of which is described in greater detail hereinafter. As can be seen from FIG. 2 the deflector 40 is provided on a front portion 42 of the firing pin. The firing pin front portion 42 is provided at its rear end with a male screwthread portion 44. The firing pin 28 has a screwthreaded bore 46 at its front end. The firing pin front portion 42 is screwed with its rearward male screwthread portion 44 into the screwthreaded bore 46 of the firing pin 28.

At the front end the firing pin 28 also has a peripherally extending sealing lip 48 which at its inside is defined or delimited by a rearwardly frustoconically tapering annular surface 50.

FIG. 2 also shows a priming means 52 into which the firing pin 28 projects with its tip 54 in the end position in order to fire the priming means 52.

The mode of operation of the initiating system 10 shown in FIGS. 1 and 2 is as follows:

The firing pin 28 is accelerated in the direction of the arrow 30 (see FIG. 1) by means of a drive, which, for example, involves a control portion (not shown), so that the tip 54 of the firing pin 28 is pushed into the powder body 12 and into the priming means 52. The firing pin 28 is retained in the final firing position shown in FIG. 2 until the gas pressure produced by the fired powder body 12 has decreased. It is only thereafter that the firing pin 28 is moved back from the final firing position shown in FIG. 2 into the starting position shown in FIG. 1 again. In those movements, the firing pin 28 moves with its grease grooves 36 into and through the grease reservoir 32. The wall of the through hole 26 is greased with the grease 37, which remains adhering in the grease grooves 36.

In the final firing position of the firing pin 28 shown in FIG. 2 the sealing lip 48 which extends at the front end peripherally around the firing pin 28 is expanded by the gas pressure generated by the fired powder body 12 so that the inside wall of the through hole 26 is sealed off rearwardly in positively locking relationship.

The deflector 40 of the firing pin 28 prevents direct bombardment of the peripherally extending sealing lip 48 by accelerated pieces of powder and/or priming means.

The entry portion 38 which is enlarged in a frustoconical configuration with a shallow cone angle, at the front end of the through hole 26 in the sealing bushing 22, prevents erosion or encrustation of the transitional edge 56 which is disposed directly in front of the firing pin 28, as would occur in the event of a sharp edge, that is to say a 90° edge.

In the piercing movement of the firing pin 28 the peripherally extending sealing lip 48 comes to a stop just in front of the transitional edge between the cylindrical through hole 18 and the entry portion 38.

LIST OF REFERENCES:

10 initiating system
12 powder body (of 10)
14 powder body chamber (of 10)
16 weapon breech block (of 10)
18 through hole (in 16 for 22)
20 enlargement (of 18 for 24)
22 sealing bushing (in 18 for 28)
24 collar (of 22)
26 firing pin through hole (in 22 for 28)
28 firing pin (in 26)
30 arrow/movement (of 28)
32 grease reservoir (in 22)
34 grease duct (to 32)
36 grease groove (in 28)
37 grease (from 32 into 36)
38 entry portion (of 26)
40 deflector (of 28)
42 firing pin front portion (of 28)
44 male screwthread portion (of 42)
46 screwthreaded bore (in 28)
48 peripherally extending sealing rib (of 28)
50 annular surface (of 48)
52 priming means (for 12)
54 tip (of 28)
56 transitional edge (of 26)

What is claimed is:

1. A mechanical initiating system for caseless ammunition comprising a weapon breech block and a powder body chamber adjoining the front end of the weapon breech block, a firing pin being axially displaceably arranged in a through hole formed in the weapon breech block, wherein a powder body being initiatable by the firing pin and having a priming means arranged in the powder body chamber, said weapon breech block having a grease reservoir, which is open facing towards the through hole, wherein the firing pin is peripherally provided with at least one grease groove, wherein the firing pin at the front end thereof is equipped with a peripherally extending sealing lip, and wherein the firing pin at the front end thereof includes a deflector preventing a direct bombardment of the peripherally extending sealing lip by accelerated pieces of powder and/or from said priming means.

2. An initiating system according to claim 1, wherein said weapon breech block has a sealing bushing which is equipped with the through hole formed in the weapon breech block for the firing pin and with the grease reservoir.

3. An initiating system according to claim 1, wherein the through hole formed in the weapon breech block for the firing pin at the end thereof facing towards the powder body chamber has an entry portion enlarging towards the powder body chamber.

4. An initiating system according to claim 3, wherein the entry portion is frustoconically enlarging at a shallow cone angle.

5. An initiating system according to claim 3, wherein the entry portion enlarges at a gentle radius.

6. An initiating system according to claim 5, wherein the deflector is arranged on a firing pin front portion which is fixedly connected to the firing pin.

7. An initiating system according to claim 6, wherein the front end of the firing pin has a screwthreaded bore, and at the rear end of the firing pin front portion there is a male screwthreaded portion that is screwed into the screwthreaded bore.

8. An initiating system according to claim 7, wherein the peripherally extending sealing lip includes a rearwardly conically tapering annular surface.

* * * * *